US009006596B2

(12) United States Patent
Chao et al.

(10) Patent No.: US 9,006,596 B2
(45) Date of Patent: Apr. 14, 2015

(54) KEYSWITCH AND KEYBOARD

(71) Applicants: Ling-Hsi Chao, Luzhu Township, Taoyuan County (TW); Chih-Chung Yen, Bade (TW)

(72) Inventors: Ling-Hsi Chao, Luzhu Township, Taoyuan County (TW); Chih-Chung Yen, Bade (TW)

(73) Assignees: Darfon Electronics (Suzhou) Co., Ltd., Suzhou, Jiangsu Province (CN); Darfon Electronics Corp., Gueishan Township, Taoyuan County (TW)

( * ) Notice: Subject to any disclaimer, the term of this patent is extended or adjusted under 35 U.S.C. 154(b) by 123 days.

(21) Appl. No.: 13/935,556

(22) Filed: Jul. 4, 2013

(65) Prior Publication Data

US 2014/0008195 A1 Jan. 9, 2014

(30) Foreign Application Priority Data

Jul. 5, 2012 (TW) ..... 101212982 U

(51) Int. Cl.

| | |
|---|---|
| ***H01H 13/70*** | (2006.01) |
| ***H01H 13/14*** | (2006.01) |
| ***H01H 3/12*** | (2006.01) |
| ***H01H 13/705*** | (2006.01) |

(52) U.S. Cl.

CPC ..... *H01H 13/14* (2013.01); *H01H 3/125* (2013.01); *H01H 13/705* (2013.01); *H01H 2227/036* (2013.01)

(58) Field of Classification Search

USPC ..... 200/5 A, 517, 344, 345, 314, 317, 512; 400/490–496

See application file for complete search history.

(56) References Cited

U.S. PATENT DOCUMENTS

| | | | | |
|---|---|---|---|---|
| 7,973,254 | B2 * | 7/2011 | Yeh et al. | 200/344 |
| 8,742,276 | B2 * | 6/2014 | Zhang | 200/520 |
| 2011/0114461 | A1 * | 5/2011 | Chen | 200/344 |
| 2014/0224632 | A1 * | 8/2014 | Chen et al. | 200/344 |

* cited by examiner

*Primary Examiner* — Edwin A. Leon
(74) *Attorney, Agent, or Firm* — Cheng-Ju Chiang

(57) ABSTRACT

A keyswitch and a keyboard are provided. A top plate of a keycap of the keyswitch, for being pressed and decoration, and a frame including groove bodies, for linking with a supporting mechanism, are separated into two components such that the top plate may be implemented as a plate structure with much thinner thickness while maintaining its strength, and the frame with the groove bodies is attached to the top plate via insert molding or adhering. The frame and the top plate form the keycap, in which the groove bodies at the frame and the top plate form sliding slots or engaging slots in cooperation with the supporting mechanism. The thickness of the keycap can be substantially reduced and meanwhile maintain the necessary stroke of the keyswitch and the strength of the keycap. The keyboard having the keyswitches is made possible for further miniaturized with thinner thickness.

20 Claims, 4 Drawing Sheets

KEYSWITCH AND KEYBOARD

FIELD OF THE INVENTION

The present invention relates to an input device, and more particularly to a keyswitch and a keyboard having a plurality of the keyswitches, wherein the keyswitch has a keycap with a thin top plate.

BACKGROUND OF THE INVENTION

When using a personal computer, a keyboard for inputting characters, symbols or numerals is one of the indispensable input devices. Moreover, for all of the consumer electronic products in the daily life or large-scale processing devices used in the industry, a keyswitch structure is used as an input device for operating the electronic products or processing devices.

Please refer to FIG. 1, which shows a schematic diagram of a keyswitch 1 of the prior art. As shown in FIG. 1, the keyswitch 1 includes a keycap 10, a supporting mechanism 12 with a shape like scissors, and a base plate 14. The supporting mechanism 12 includes two supports 120, 122. The supports 120, 122 are attached between the keycap 10 and the base plate 14, respectively, for supporting the keycap 10. The keycap 10 can move vertically relative to the base plate 14 with the movement of the supporting mechanism 12.

As shown in FIG. 1, a keycap 10 includes a top plate 100, two engaging slots 102 and two sliding slots 104. The engaging slots 102 and the sliding slots 104 can engage with the supports 120, 122, respectively. Generally speaking, the keycap 10 can be formed by injection molding so that the top plate 100, the engaging slots 102 and the sliding slots 104 are integrally formed. Since the injection molding technique is used, and the engaging slots 102 and the sliding slots 104 must be formed on the top plate 100, the keycap 10 may be formed of plastic materials. However the strength of plastic keycap 10 becomes weak if one wants to make the keycap 10 thinner.

SUMMARY OF THE INVENTION

In order to solve the above problem, the invention provides a keyswitch, including a keycap, a base plate and a supporting mechanism. The keycap includes a top plate and a frame. The frame is attached on a side of the top plate, and is a hollow structure. The supporting mechanism is disposed between the keycap and the base plate.

The invention also provides a keyboard, including a base plate and a plurality of keyswitches. The plurality of keyswitches is disposed on the base plate, wherein any one of the keyswitches includes a keycap and a supporting mechanism. The keycap includes a top plate and a frame. The frame is attached on a side of the top plate, and is a hollow structure. The supporting mechanism is disposed between the keycap and the base plate.

In an embodiment of the invention, the top plate is a plate structure with a thickness smaller than or equal to 0.4 millimeter, and the top plate is made of stainless-steel, aluminum or plastic material.

In an embodiment of the invention, the frame is attached to the side of the top plate via insert molding.

In an embodiment of the invention, the frame has a frame body, a first groove body and a second groove body, the first groove body and the second groove body are disposed on a side of the frame body, the first groove body extends on a corner between adjacent sides of the frame body or on one of the sides, and the second groove body extends on a corner between adjacent sides of the frame body or on one of the sides. The first groove body and the second groove body are L-shaped.

In an embodiment of the invention, the first groove body and the top plate form a first sliding slot, the second groove body and the top plate form a second sliding slot, the base plate has a base plate sliding slot and a base plate engaging slot, the supporting mechanism includes a first lever and a second lever. The first lever has a first sliding portion and a first pivoting portion, the first sliding portion is slidably disposed in the first sliding slot, while the first pivoting portion is rotatably pivoted in the base plate engaging slot. The second lever and the first lever are pivoted with each other, the second lever has a second sliding portion and a third sliding portion, the second sliding portion is slidably disposed in the second sliding slot, while the third sliding portion is slidably disposed in the base plate sliding slot.

In an embodiment of the invention, the first groove body and the top plate form a first sliding slot, the second groove body and the top plate form a first engaging slot, the base plate has a base plate sliding slot and a base plate engaging slot, the supporting mechanism includes a first lever and a second lever. The first lever has a first sliding portion and a first pivoting portion, the first sliding portion is slidably disposed in the first sliding slot, while the first pivoting portion is rotatably pivoted in the base plate engaging slot. The second lever and the first lever are pivoted with each other, the second lever has a second sliding portion and a second pivoting portion, the second sliding portion is slidably disposed in the base plate sliding slot, while the second pivoting portion is rotatably pivoted in the first engaging slot.

In the keyswitch and keyboard of the invention, the keycap of each keyswitch is separated into a top plate and a frame, so that the top plate can be made by using metal or other material that can be easily made to have a plate shape. The thickness of the top plate of the keycap can be substantially reduced and meanwhile the necessary stroke of the keyswitch and the strength of the keycap are maintained. The keyboard with such structure is made possible for further miniaturized with thinner thickness in order to comply with the requirements of the miniaturized electronic devices.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
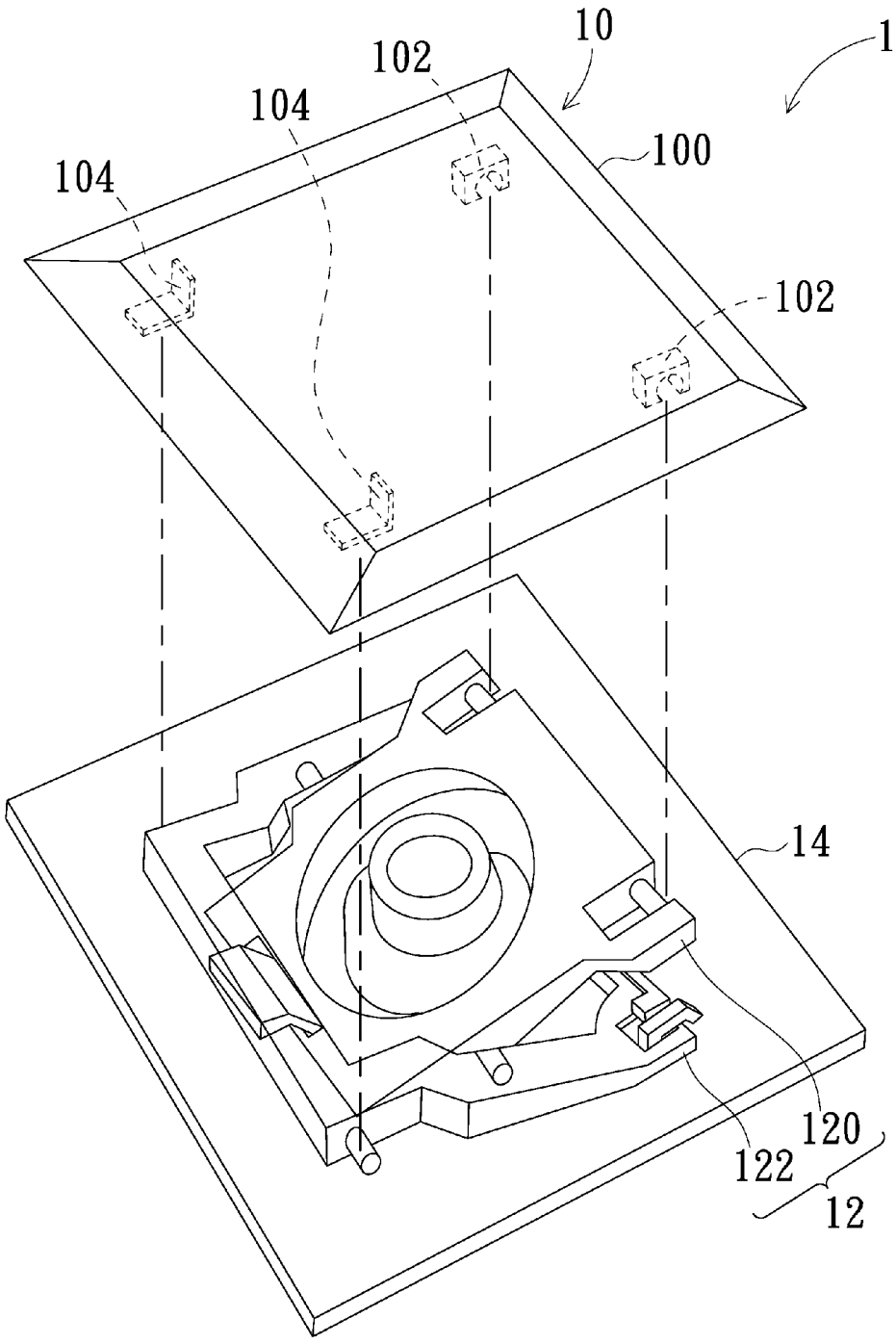
FIG. 1 (Prior Art)
FIG. 1 is a schematic diagram showing a keyswitch of the prior art.
Figure 2:
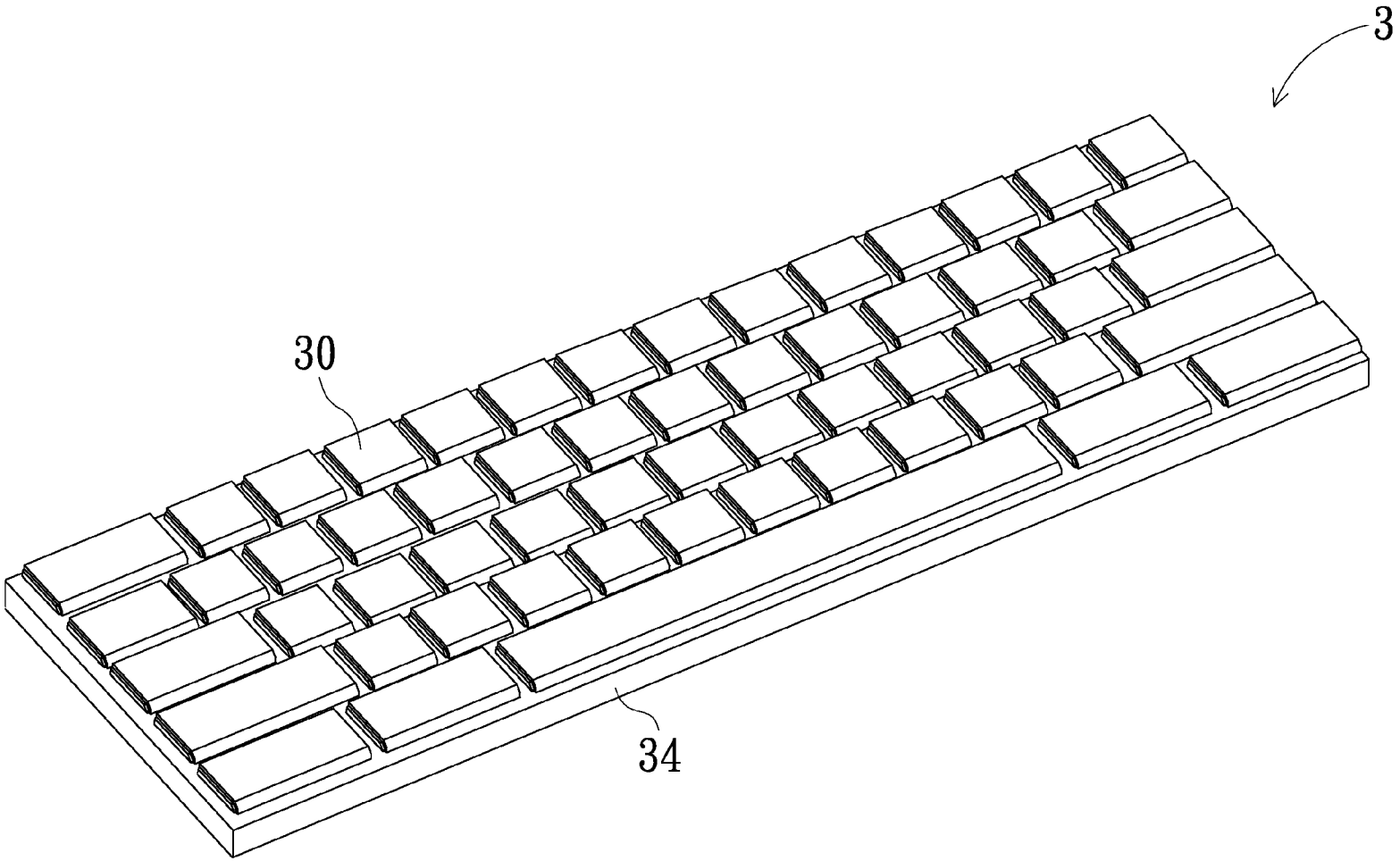
FIG. 2 is a schematic diagram showing a keyboard of an embodiment of the invention.

Please refer to FIG. 2, which is a schematic diagram showing a keyboard of an embodiment of the invention. The keyboard 3 has a plurality of keyswitches 30 and a base plate 34. The keyswitches 30 of the keyboard 3 are disposed on the base plate 34. The keyswitches 30 can be mechanical keyswitches or membrane keyswitches. In the keyswitch 30, a scissors type supporting mechanism is used.

Figure 3:
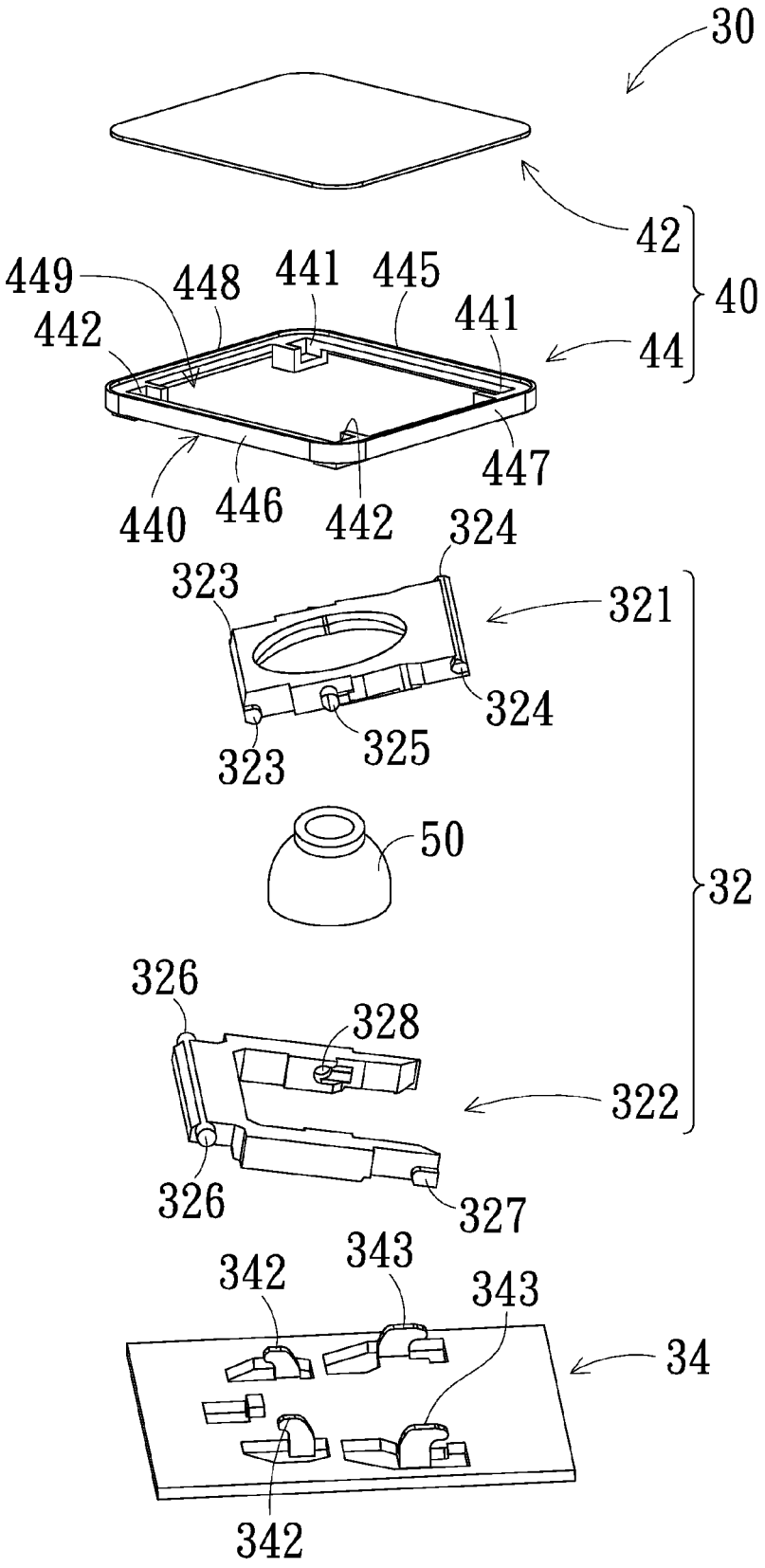
FIG. 3 is an exploded view drawing showing components of a keyswitch of an embodiment of the invention.

Please refer to FIG. 3, which is an exploded view drawing showing components of the keyswitch 30 of the embodiment of the invention. The keyswitch 30 includes a keycap 40, a base plate 34, an elastic member 50 and a supporting mechanism 32. The keycap 40 is disposed on the base plate 34, and the supporting mechanism 32 is disposed between the keycap 40 and the base plate 34. The supporting mechanism 32 supports a vertical movement of the keycap 40, and enables the keycap 40 to move vertically downward relative to the base plate 34 when the keycap 40 is pressed. After that, the keycap 40 can be returned upwardly by the elastic member 50.

The supporting mechanism 32 preferably has a scissors-like structure. In another embodiment, the supporting mechanism 32 can has other structure to support the keycap 40. The supporting mechanism 32 includes a first lever 321 and a second lever 322. The first lever 321 has an upper end, a lower end, and pivot axes 325. The upper end includes first sliding portions 324, and the lower end includes first pivoting portions 323. The second lever 322 has an upper end, a lower end, and pivot grooves 328. The upper end includes second sliding portions 326, and the lower end includes third sliding portions 327. The first lever 321 and the second lever 322 pivot with each other by the pivot axes 325 and the pivot grooves 328. The base plate sliding slots 343 and base plate engaging slots 342 are formed on the base plate 34 in corresponding to the supporting mechanism 32. The first pivoting portions 323 of the first lever 321 are rotatably pivoted in the base plate engaging slots 342, while the third sliding portions 327 of the second lever 322 are slidably and rotatably received within the base plate sliding slots 343. Therefore, when the keycap 40 is pressed to move down the supporting mechanism 32, the first pivoting portions 323 rotate in the base plate engaging slots 342, while the third sliding portions 327 rotatably slide in the base plate sliding slots 343. The elastic member 50 is disposed through the first lever 321 and the second lever 322 and abuts the keycap 40.

In the embodiment of the invention, the keycap 40 includes a top plate 42 and a frame 44. The top plate 42 and the frame 44 are two independent components, which can be manufactured separately, and can be made by the same or different materials or manufacturing methods. The top plate 42 of the keycap 40 is a plate structure. In the embodiment of the invention, the top plate 42 can be made of stainless-steel, aluminum or plastic material. When maintaining strength of the top plate 42, the thickness of the top plate 42 can be controlled to be smaller than or equal to 0.4 millimeter, and preferably between 0.2 millimeter and 0.4 millimeter.

The frame 44 is attached on a side of the top plate 42. The frame 44 can be attached to the top plate 42 via adhering or insert molding. In the embodiment of the invention, the frame 40 is a rectangular-shaped structure having a frame opening 449 at its center, and the elastic member 50 abuts a lower surface of the top plate 42 through the frame opening 449. The frame 44 is a hollow structure, which has a hollow frame body 440, first groove bodies 441 and second groove bodies 442. The frame 44 constitutes a portion of a linking structure for cooperation with the supporting mechanism 32. As shown in FIG. 3, the first groove bodies 441 and the second groove bodies 442 are disposed on side walls 445, 446 of the frame body 440, respectively. In this embodiment, the first groove bodies 441 extend on the side wall 445 or on the corners between the side wall 445 and the side walls 447, 448, while the second groove bodies 442 extend on the side wall 446 or on the corners between the side wall 446 and the side walls 447, 448. The first groove body 441 has a first upward opening, and the second groove body 442 has a second upward opening In another embodiment, the frame may be a loop-shaped structure with a frame opening at its center. The upper surfaces of the four side walls 445, 446 447, 448 are higher than the upper surface of the first groove bodies 441 and the second groove bodies 442.

Figure 4:
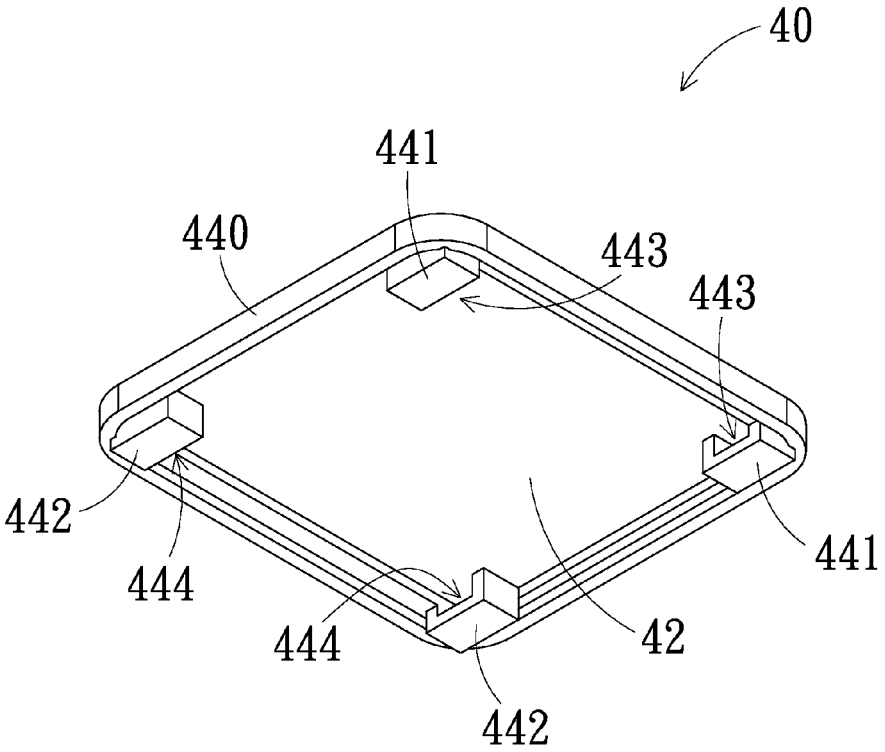
FIG. 4 is schematic diagram showing a keycap of the keyswitch of FIG. 3.

Please also refer to FIG. 4, which is a schematic diagram showing the keycap 40 of FIG. 3. As shown in FIG. 4, when the top plate 42 of the keycap 40 is linked with the frame 44 to form an integral structure, the top plate 42 seals the first and second upward openings. Such that, first position-limiting spaces such as first sliding slots 443 are formed between the first groove bodies 441 of the frame 44 and the top plate 42, and second position-limiting spaces such as second sliding slots 444 are formed between the second groove bodies 442 and the top plate 42. The first sliding slots are, for example, horizontally extended. In this embodiment, since the first groove bodies 441 and the second groove bodies 442 are L-shaped structures extending on the side walls 445, 446 of the frame body 440, the first sliding slots 443 and the second sliding slots 444 formed therebetween with the top plate 42 provide places to slidably dispose the first lever 321 and the second lever 322 of the supporting mechanism 32. More specifically, the first sliding portions 324 of the first lever 321 of the supporting mechanism 32 are movably received in the first sliding slots 443, while the second sliding portions 326 of the second lever 322 are movably received in the second sliding slots 444. When the keycap 40 is pressed to move down the supporting mechanism 32, the first sliding portions 324 slide in the first sliding slots 443, while the second sliding portions 326 slide in the second sliding slots 444.

Except the embodiment shown in FIG. 3, in other embodiments of the invention, the two levers of the supporting mechanism 32 can be respectively linked with the base plate 34 and the keycap 40 by different combinations of sliding portions with sliding slots, or pivoting portions with engaging slots. For example, for the second groove bodies 442 on the frame 44 of the keycap 40, the structure of the second groove bodies 442 extending on the frame body 440 can also form first engaging slots with the top plate 42, while the cooperating second levers 322 can have second pivoting portions to rotatably pivot in the first engaging slots. When the keycap 40 is pressed to move down the supporting mechanism 32, the first sliding portions 324 of the first lever 321 slide in the first sliding slots 443, while the second pivoting portions of the second lever 322 rotate in the first engaging slots of the keycap 40. In another embodiment, the first position-limiting space may be a pivot groove, and the upper end of the first lever is rotatably connected to the first position-limiting space. In addition, in the embodiment shown in FIG. 3, the first groove bodies 441 and the second groove bodies 442 are all disposed on the corners of the frame body 440 so that the openings of the first groove bodies 441 face each other, and the openings of the second groove bodies 442 face each other. Thus, the corresponding first sliding portions 324 and second sliding portions 326 are formed as pillar structures protruding outwardly as shown in the FIG. 3. However, the first groove bodies 441 or the second groove bodies 442 can also be disposed on the corresponding side wall 445 or 446 away from the corners, so that the openings of the first groove bodies 441 (or the second groove bodies 442) can face the side wall 447 and the side wall 448, respectively. Thus, the corresponding first sliding portions 324 and second sliding portions 326 are formed as pillar structures protruding inwardly. Although several possible aspects are listed on the above, other modified aspects can also be adapted without further description here.

For the keyswitch and the keyboard having those keyswitches of the invention, the keycap is formed by two separated components: the top plate and the frame. The top plate normally is decorated with character or symbol, and a user finger can touch the top plate to press down the keyswitch. The frame includes groove bodies which constitute portions of the linking structures for cooperation with the supporting mechanism. The top plate may be made of the material which is stronger than the material of the frame, and shaped as a plate structure, so its thickness is dramatically reduced while maintaining its strength substantially the same. The frame with the groove bodies is then attached to the top plate via insert molding or adhering, so the groove bodies and the top plate form sliding slots or engaging slots in cooperation with the supporting mechanism. The thickness of the keycap can be dramatically reduced and the strength of the keycap are maintained the same. Therefore, the thickness of the keyswitch with such keycap structure is also reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A keyswitch, comprising:

a keycap, having:

a top plate; and a frame, wherein the frame is a hollow structure with a first groove body and a second groove body, when the frame is attached with the top plate, the first groove body and the top plate form a first position-limiting space, and the second groove body and the top plate form a second position-limiting space;

a base plate; and a supporting mechanism disposed between the keycap and the base plate, the supporting mechanism having a first lever and a second lever, the first lever and the second lever respectively having an upper end and an lower end, the upper end of the first lever being movably received within the first position-limiting space, and the upper end of the second lever being movably received within the second position-limiting space.

2. The keyswitch according to claim 1, wherein the top plate is made of a first material, and the frame is made of a second material, and the first material is stronger than the second material.

3. The keyswitch according to claim 1, wherein the first position-limiting space forms a first sliding slot, and the second position-limiting space forms a second sliding slot.

4. The keyswitch according to claim 1, wherein the first position-limiting space forms a first sliding slot, and the second position-limiting space forms a first engaging slot.

5. The keyswitch according to claim 1, wherein the first groove body and the second groove body are L-shaped.

6. The keyswitch according to claim 1, wherein the frame further comprises four side walls, the upper surfaces of the four side walls are higher than the upper surface of the first groove body and the second groove body.

7. A keycap adapted to be movably connected with a supporting mechanism, the keycap comprising:

a top plate; and a frame, wherein the frame is a hollow structure with a first groove body and a second groove body, when the frame is attached with the top plate, the first groove body and the top plate form a first position-limiting space, the second groove body and the top plate form a second position-limiting space, and upper ends of the supporting mechanism movably connect with the first position-limiting space and the second position-limiting space.

8. The keycap according to claim 7, wherein the first position-limiting space forms a first sliding slot, and the second position-limiting space forms a second sliding slot.

9. The keycap according to claim 7, wherein the first position-limiting space forms a first sliding slot, and the second position-limiting space forms a first engaging slot.

10. The keycap according to claim 7, wherein the first groove body and the second groove body are L-shaped.

11. The keycap according to claim 7, wherein the top plate is made of a first material, and the frame is made of a second material, and the first material is stronger than the second material.

12. A keyswitch, comprising:

a keycap, having:

a frame having a first groove body with a first upward opening; and a top plate linked on the frame so that the top plate seals the first upward opening, a first position-limiting space being formed between the top plate and the first groove body;

a base plate disposed below the keycap; and a supporting mechanism disposed between the keycap and the base plate, the supporting mechanism having:

a first lever having an upper end, the upper end of the first lever is limited so as to move along the first position-limiting space; and a second lever rotatably connected with the first lever to support an up-and-down movement of the keycap.

13. The keyswitch according to claim 12, wherein the frame further comprises four side walls, the upper surfaces of the four side walls are higher than the upper surface of the first groove body.

14. The keyswitch according to claim 12, wherein the frame is a rectangular-shaped structure with two first groove bodies, the first groove bodies are respectively disposed at two adjacent corners of the rectangular-shaped structure.

15. The keyswitch according to claim 12, wherein the frame further has a second groove body with a second upward opening, the top plate seals the second upward opening, the top plate and the second groove body form a second position-limiting space, the second lever further has an upper end, the upper end of the second lever is limited so as to move along the second position-limiting space.

16. The keyswitch according to claim 12, wherein the first position-limiting space is a sliding slot extending horizontally, and the upper end of the first lever is limited so as to slide horizontally along the sliding slot.

17. The keyswitch according to claim 12, wherein the first position-limiting space is a pivot groove, and the upper end of the first lever is limited so as to rotate but not slide in the pivot groove.

18. The keyswitch according to claim 12, wherein the top plate is made of a first material, and the frame is made of a second material, and the first material is stronger than the second material.

19. The keyswitch according to claim 12, wherein the keyswitch further comprises an elastic member disposed through the first lever and the second lever and abutting the keycap, so that the elastic member provides a restoring force to move the keycap upwardly.

20. The keyswitch according to claim 19, wherein the frame is a loop-shaped structure with a frame opening at its center, and the elastic member abuts a lower surface of the top plate through the frame opening.

* * * * *